US006406321B1

(12) United States Patent
Hayashi et al.

(10) Patent No.: US 6,406,321 B1
(45) Date of Patent: Jun. 18, 2002

(54) AUXILIARY STRUCTURE FOR CONNECTING CONNECTOR FOR USE IN PORTABLE TELEPHONE

(75) Inventors: Masahiko Hayashi, Higashiosaka; Yukio Tsukakoshi, Daito; Tadahiko Yabu, Hirakata, all of (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/983,349

(22) Filed: Oct. 24, 2001

(30) Foreign Application Priority Data

Oct. 31, 2000 (JP) ..... 2000-332709

(51) Int. Cl.[7] ..... H01R 13/64
(52) U.S. Cl. ..... 439/374; 439/135
(58) Field of Search ..... 439/374, 271, 439/272, 273, 283, 521, 587, 588, 589, 135, 136, 137, 556, 559, 528, 519, 138, 139, 140

(56) References Cited

U.S. PATENT DOCUMENTS 4,773,032 A * 9/1988 Uehara et al. ..... 364/709.04
4,795,354 A * 1/1989 Owen ..... 439/137
5,728,974 A * 3/1998 Kitoh et al. ..... 174/65.55
5,769,646 A * 6/1998 Cavello et al. ..... 439/136
5,812,660 A * 9/1998 Suzuki et al. ..... 379/438
6,101,372 A * 8/2000 Kubo ..... 455/90
6,183,274 B1 * 2/2001 Allum ..... 439/135
6,226,536 B1 * 5/2001 Miyashita ..... 455/567
6,254,428 B1 * 7/2001 Murakami et al. ..... 439/556
6,307,934 B1 * 10/2001 Moster et al. ..... 379/483

* cited by examiner

*Primary Examiner*—P. Austin Bradley
*Assistant Examiner*—Ross Gushi
(74) *Attorney, Agent, or Firm*—Armstrong, Westerman & Hattori, LLP

(57) ABSTRACT

The auxiliary structure for connecting a connector for use in portable telephones of the present invention provides structure for connecting a connector for charging a telephone body and/or performing data communication with the telephone body to a socket exposed from an opening provided on the telephone body. Removably attached to the opening is a connecting auxiliary member which is made of softer material than the one used for a casing of the telephone body. The connecting auxiliary member is formed with an insertion hole for the connector to be fitted into and formed with a guide face for guiding an end portion of the connector to a position of engagement with the socket. Accordingly, when the connector is connected to the socket of the telephone body, the end portion of the connector can easily be engaged with the socket, and the connector is unlikely to be damaged.

4 Claims, 5 Drawing Sheets

AUXILIARY STRUCTURE FOR CONNECTING CONNECTOR FOR USE IN PORTABLE TELEPHONE

FIELD OF THE INVENTION

The present invention relates to structure for connecting a connector for charge and/or data communication for use in portable telephones.

BACKGROUND OF THE INVENTION

As shown in FIG. 9, with a conventional portable telephone, an I/F socket 92 is exposed at an opening 91 provided on one end of a telephone body 9. An I/F connector 2 is fitted into the opening 91 to have an end portion 21 of the I/F connector 2 engaged with the I/F socket 92, to connect the telephone body 9 to a personal computer, whereby data communication is performed with a portable telephone.

However, when the end portion 21 of the I/F connector 2 is engaged with the I/F socket 92 of the portable telephone 9, difficulty is encountered in adjusting the positions of the portion 21 and the socket 92. If the connector 2 is pushed, with force, with the positions displaced, the connector 2 is caused to hit an end portion of a casing entailing the likelihood of causing damage.

SUMMARY OF THE INVENTION

An object of the present invention is to provide auxiliary structure for connecting a connector wherein an end portion of the connector can easily be engaged with a socket of a portable telephone body and the connector is unlikely to be damaged when the connector is connected to the socket of the portable telephone.

In the auxiliary structure for connecting a connector for use in a portable telephone of the invention, a connecting auxiliary member 3 made of softer material than the one used for a casing of the telephone body 1 is fixed to an opening 11 of a telephone body 1. The connecting auxiliary member 3 is formed with an insertion hole 31 for the connector 2 to be fitted into, and formed with a guide face 32 surrounding the insertion hole 31 for guiding an end portion 21 of the connector 2 to the position of engagement with a socket 5.

According to the auxiliary structure for connecting a connector of the invention described, when the connector 2 is fitted into the insertion hole 31 of the connecting auxiliary member 3 to connect the connector 2 for charge and/or data communication to the socket 5 of the telephone body 1, the connector 2 is guided by the guide face 32 of the connecting auxiliary member 3 to have the end portion 21 led automatically to the position of engagement with the socket 5, so that the user needs not to make delicate adjustment of the position. In this step, even if the connector 2 is pressed forcefully against the guide face 32 of the connecting auxiliary member 3, the connector is unlikely to be damaged since the connecting auxiliary member 3 is made of softer material than the one used for the casing.

Stated specifically, the connecting auxiliary member 3 is removably attached to the opening 11 of the telephone body 1. The closure member 4 for the opening equipped with a cover member 40 for closing the opening 11 can be attached to the opening 11 of the telephone body 1, and is interchangeable with the connecting auxiliary member 3.

With this specific construction, one of the connecting auxiliary member 3 and the closure member 4 for the opening is selectively usable according to whether the data communication, for example, is performed using a personal computer. In other words, the user who will conduct the data communication usually attaches the connecting auxiliary member 3 to the portable telephone body 1 to perform charge and/or data communication with use of the I/F connector 2. On the other hand, the user who will not conduct the data communication usually attaches the closure member 4 for the opening to the telephone body 1, and when a battery is to be charged, the closure member 4 for the opening is removed to perform charging, for example, with use of a charger comprising contact electrodes.

As described above, with the auxiliary structure for connecting a connector for use in the portable telephone of the invention, when the connector is connected to the socket of the portable telephone body, the end portion of the connector can be engaged with the socket easily. Further, the connector is unlikely to be damaged.

DETAILED DESCRIPTION OF EMBODIMENT

Figure 3:
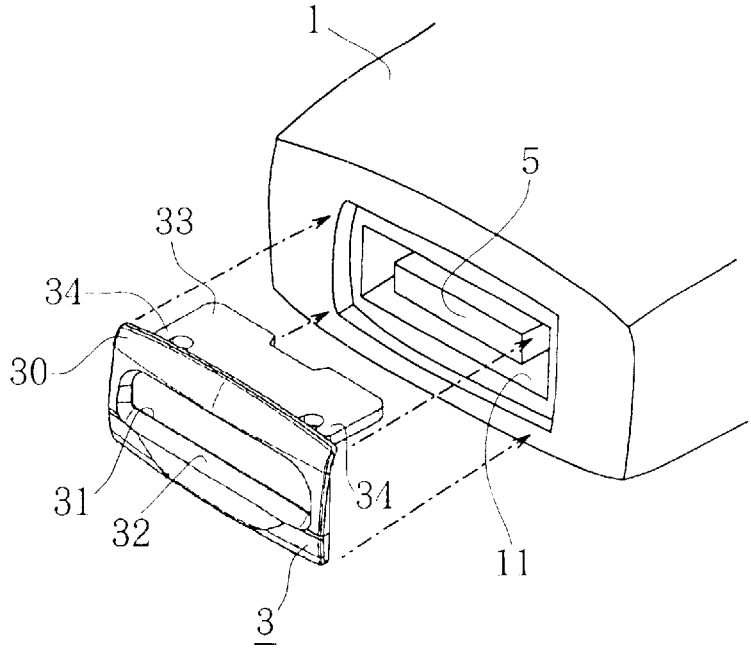
FIG. 3 is a perspective view showing the state wherein a connecting auxiliary member is removed from the telephone body.
Figure 4:
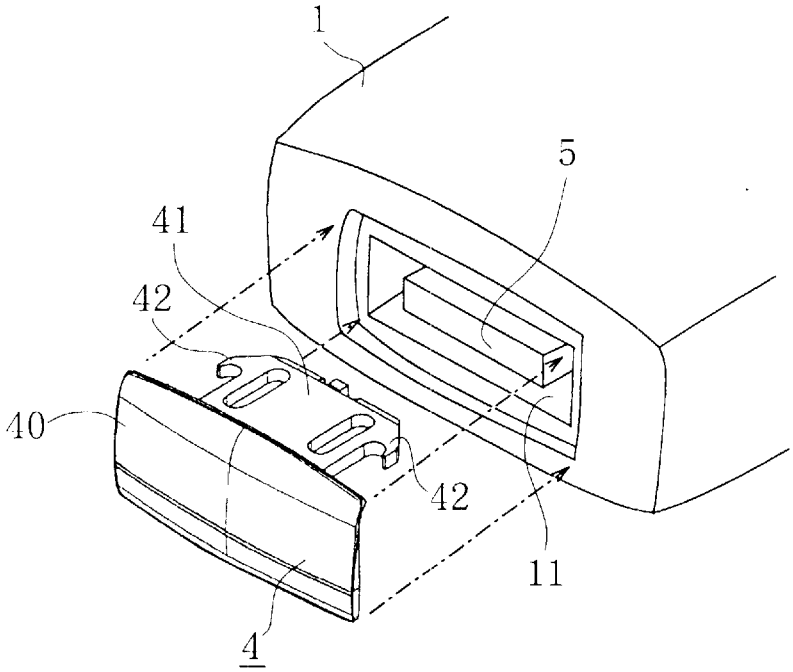
FIG. 4 is a perspective view showing the state wherein a closure member for an opening is removed from the telephone body.

An embodiment of the present invention will be described below in detail with reference to the drawings. As shown in FIG. 3 and FIG. 4, a portable telephone body 1 of the invention has an opening 11 on a lower end portion of a casing made of ABS. A connecting auxiliary member 3 and a closure member 4 for the opening both of which are made of synthetic rubber can be attached interchangeably to the opening 11.

Figure 1:
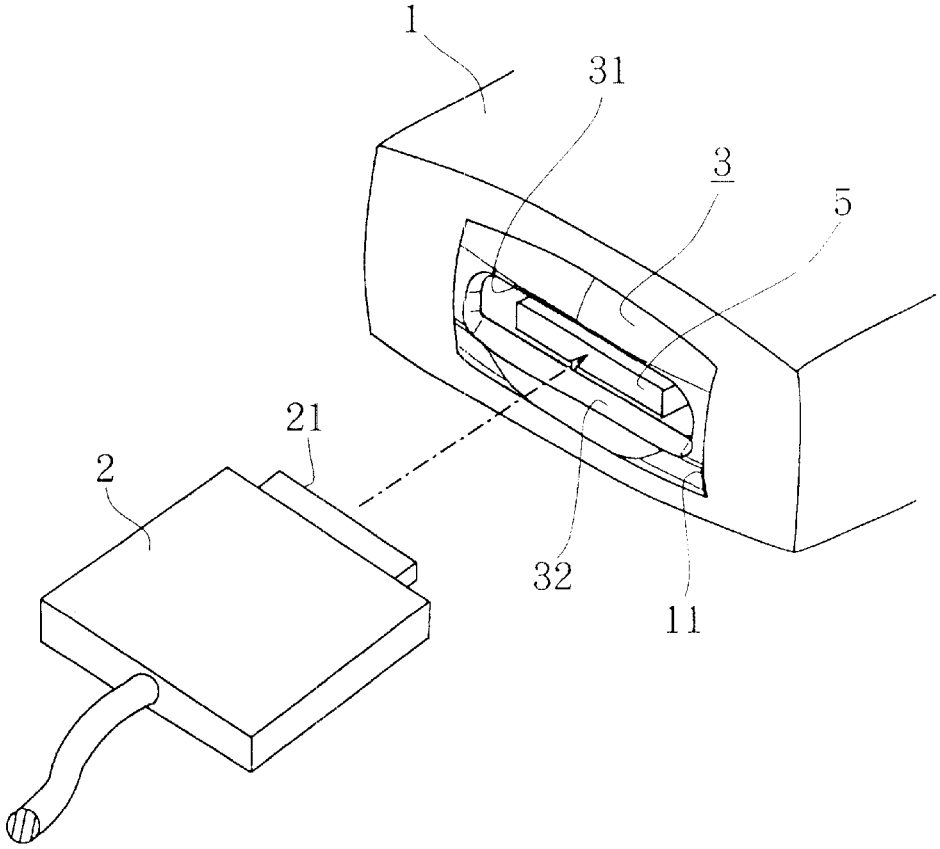
FIG. 1 is a perspective view of auxiliary structure for connecting a connector for use in a portable telephone of the present invention.

The connecting auxiliary member 3 is attached to the telephone body 1 when an I/F connector 2 is connected to the telephone body 1 to perform charge and/or data communication, as shown in FIG. 1. On the other hand, the closure member 4 for the opening is provided for the user who will perform data communication less frequently. When a battery is to be charged, the closure member 4 for the opening is removed from the telephone body 1, to place the telephone body 1 directly on a charger for its exclusive use charging the battery, or to connect an I/F connector 2 to the telephone body 1 charging the battery through a micro computer.

Figure 5:
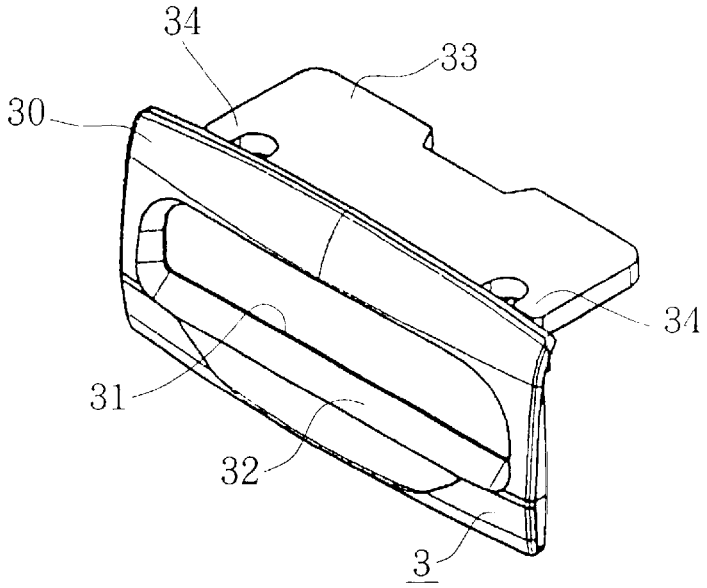
FIG. 5 is an enlarged perspective view of the connecting auxiliary member as it is seen from the front thereof.
Figure 6:
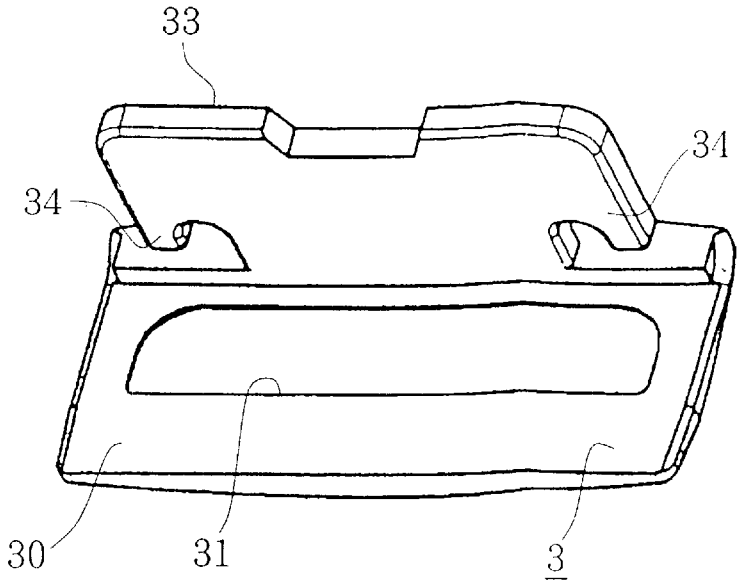
FIG. 6 is an enlarged perspective view of the connecting auxiliary member as it is seen from behind.

With respect to FIG. 5 and FIG. 6, the connecting auxiliary member 3 comprises a cover 30 capable of closing the opening 11 of the telephone body 1. The cover 30 is formed with an insertion hole 31 for having the I/F connector 2 fitted therein. A guide face 32 for guiding the I/F connector 2 for fitting is formed around an entire periphery surrounding the insertion hole 31. Accordingly, the insertion hole 31 of the connecting auxiliary member 3 has a large opening on a front side of the cover 30.

The cover 30 of the connecting auxiliary member 3 has an inner face having a lug 33 projecting therefrom. Opposite ends of the lug 33 are formed with a pair of hooks 34, 34 to be engaged with a pair of engagement pins (not shown), respectively, provided inside the telephone body 1.

Figure 7:
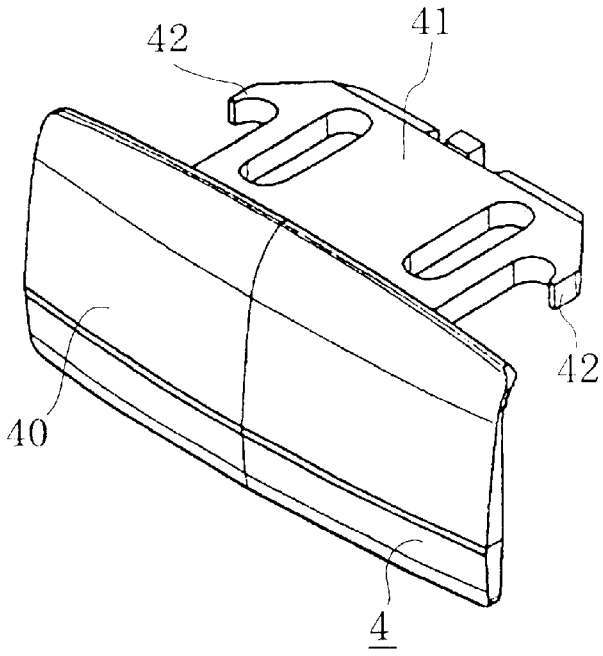
FIG. 7 is an enlarged perspective view of the closure member for the opening as it is seen from the front thereof.
Figure 8:
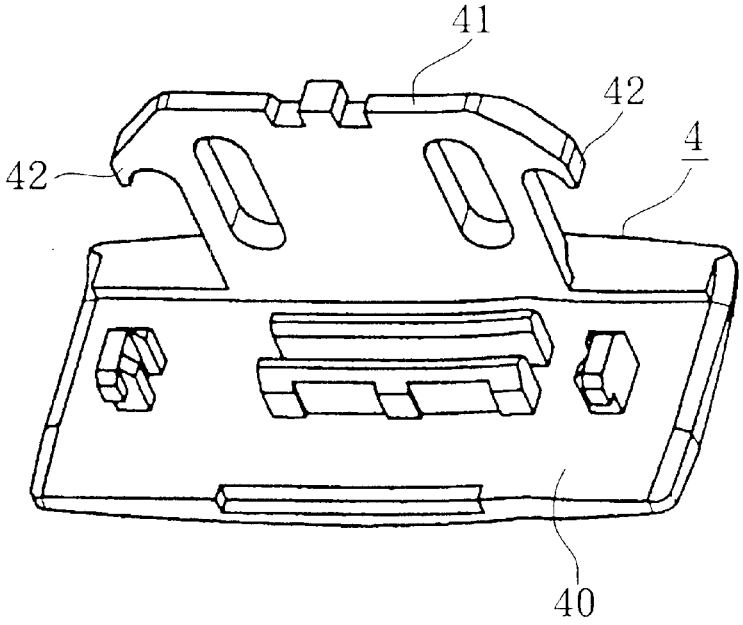
FIG. 8 is an enlarged perspective view of the closure member for the opening as it is seen from behind.
Figure 9:
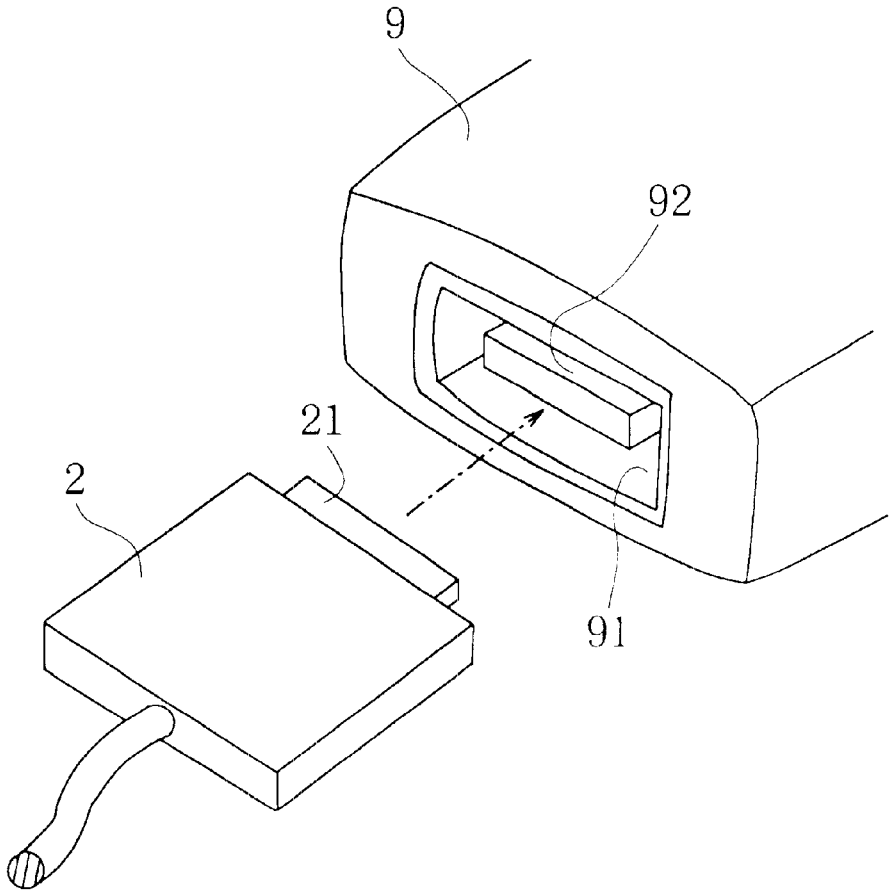
FIG.9 PRIOR ART
FIG. 9 is a perspective view showing structure for connecting a connector of a conventional portable telephone.

On the other hand, the closure member 4 for the opening comprises a cover 40 for closing the opening 11 of the telephone body 1 and the cover 40 is not formed with an opening, as shown in FIG. 7 and FIG. 8. The cover 40 has an inner face having a lug 41 projecting therefrom. Opposite ends of the lug 41 are formed with a pair of hooks 42, 42 to be engaged with a pair of engagement pins (not shown), respectively, provided inside the telephone body 1.

As shown in FIG. 1, the I/F socket 5 of the telephone body 1 is exposed at an innermost portion of the insertion hole 31 of the connecting auxiliary member 3, with the connecting auxiliary member 3 attached to the telephone body 1. The I/F connector 2 is fitted into the insertion hole 31 of the connecting auxiliary member 3 to have an end portion 21 of the I/F connector 2 engaged with the I/F socket 5.

Figure 2:
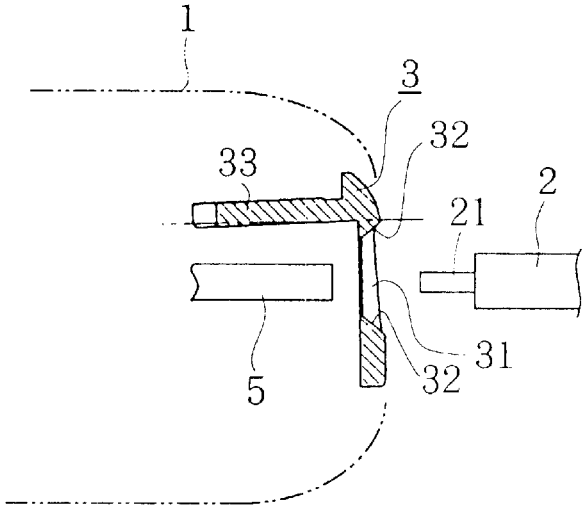
FIG. 2 is a side elevation partly broken away and showing said structure.

In this step, the connecting auxiliary member 3 is formed with the guide face 32 which surrounds the insertion hole 31 and reduces toward the I/F socket 5, as shown in FIG. 2, so that the I/F connector 2 is fitted into the hole 31 while guided by the guide face 32 to have the end portion 21 engaged with the I/F socket 5.

Accordingly, when the I/F connector 2 is connected to the telephone body 1, the user adjusts the position of the I/F connector 2 relative to the insertion hole 31 having a large opening on a front side of the connecting auxiliary member 3, whereby the user needs not to make delicate adjustment of the positions. If the I/F connector 2 is pressed forcefully against the guide face 32 of the connecting auxiliary member 3, the elastic deformation of the connecting auxiliary member 3, which is made of synthetic rubber, reduces the force which the I/F connector 2 receives. Consequently, the I/F connector 2 is unlikely to be damaged.

The device of the invention is not limited to the foregoing embodiment in construction but can be modified variously by one skilled in the art without departing from the spirit of the invention as set forth in the appended claims.

What is claimed:

1. A connecting auxiliary member for connecting a connector 2 for charging a portable telephone body 1 and/or performing data communication with the telephone body 1 to a socket 5 exposed from an opening 11 provided on the telephone body 1, the wherein a connecting member 3 is made of softer material than material used for a casing of the telephone body 1 and is attached to an opening 11 of the telephone body 1, and the connecting auxiliary member 3 is formed with an insertion hole 31 for the connector 2 to be fitted into and formed with a guide face 32 surrounding the insertion hole 31 for guiding an end portion 21 of the connector 2 to the position of engagement with the socket 5.

2. The connecting auxiliary member for connecting a connector according to claim 1 wherein the guide face 32 of the connecting auxiliary member reduces toward the socket 5.

3. The connecting auxiliary member for connecting a connector according to claim 1 wherein the connecting auxiliary member 3 is removably attached to the opening 11 of the telephone body 1.

4. The connecting auxiliary member for connecting a connector according to claim 3 wherein a closure member 4 is provided for the opening equipped with a cover member 40 for closing the opening 11 and can be attached to the opening 11 of the telephone body 1, and is interchangeable with the connecting auxiliary member 3.

* * * * *

UNITED STATES PATENT AND TRADEMARK OFFICE

CERTIFICATE OF CORRECTION

PATENT NO. : 6,406,321 B1 
DATED : June 18, 2002
INVENTOR(S) : Masahiko Hayashi et al.

It is certified that error appears in the above-identified patent and that said Letters Patent is hereby corrected as shown below:

Column 4,
Line 12, after "A connecting auxiliary member" insert -- (3) --;
Line 16, after "telephone body 1" delete "the", and after the word "wherein", change "a connecting" to -- the connecting auxiliary --.

Signed and Sealed this

Tenth Day of December, 2002

JAMES E. ROGAN
*Director of the United States Patent and Trademark Office*